US008484776B1

(12) United States Patent
Su

(10) Patent No.: US 8,484,776 B1
(45) Date of Patent: Jul. 16, 2013

(54) CRADLE

(76) Inventor: Wanli Su, Fujian (CN)

( * ) Notice: Subject to any disclaimer, the term of this patent is extended or adjusted under 35 U.S.C. 154(b) by 0 days.

(21) Appl. No.: 13/448,602

(22) Filed: Apr. 17, 2012

(51) Int. Cl.
*A47D 9/00* (2006.01)

(52) U.S. Cl.
USPC ..... 5/104; 5/101

(58) Field of Classification Search
USPC ..... 5/11, 93.1, 101–109, 124–126, 244
See application file for complete search history.

(56) References Cited

U.S. PATENT DOCUMENTS

| | | | | | |
|---|---|---|---|---|---|
| 81,757 | A * | 5/1868 | Delana | ..... | 5/109 |
| 871,692 | A * | 11/1907 | Gray | ..... | 5/101 |
| 1,021,701 | A * | 3/1912 | Prendergast | ..... | 5/210 |
| 1,597,716 | A * | 8/1926 | Blaszak | ..... | 5/104 |
| 3,842,450 | A * | 10/1974 | Pad | ..... | 5/109 |
| 7,020,914 | B2 * | 4/2006 | Miyakawa | ..... | 5/104 |

* cited by examiner

*Primary Examiner* — Michael Trettel
(74) *Attorney, Agent, or Firm* — Kratz, Quintos & Hanson, LLP

(57) ABSTRACT

The present invention disclose a new cradle, including: a cradle frame, with a limiting rod extending along the height set on it; a cradle body, which move up and down along the height of the cradle frame; elastic connecting pieces, which are connected between the cradle frame and the cradle body; a noise reducing component, which includes two parallel mounting plates, two opposite 1st pulleys installed on two mounting plates respectively as well as two opposite 2nd pulleys installed between two mounting plates, wherein the rotating axis of the 2nd pulley is perpendicular to that of the 1st pulley and the limiting rod passes through the clearance enclosed by the two 1st and the two 2nd pulleys, with a mounting plate fixed to the body of the cradle. The up and down reciprocating movement can effectively facilitate the baby's sleep (especially having better effects for babies more than one full year old); at the same time, by adopting the noise reducing device and changing sliding friction to rolling friction, the present invention can effectively reduce the noise and resistance generated during the up-down movement of the body of the cradle, so that the baby's sleep will not be influenced due to noise.

7 Claims, 2 Drawing Sheets

CRADLE

BACKGROUND OF THE INVENTION

1. Technical Field

The present invention relates to a baby product, and more especially to a new cradle.

2. Description of the Related Art

With the development of society as well as people's growing attention to children's healthy growth, the cradle, as a kind of baby equipment, has become essential in baby-raising families, baby hospitals, and nurseries.

Common cradles all include a frame and a body on which babies can lie. The cradle, whose body is hung on the frame, makes babies feel so comfortable that they can fell asleep quickly by left-right swinging. For the cradle above in the prior art, its body is generally connected to the frame with multiple springs, so that, when the body of the cradle is rocked, a noise from the metallic springs, which influences the baby's sleep, will be heard. In addition, the cradle cannot be moved without permission because it is unstable during moving and a swinging to the left or to the right will be generated. As the body of the cradle is not fixed, when the baby needs to be taken out of it, its body will become unstable, which will create certain burden to the adult who is going to take the baby. At the same time, its structure for swinging to the left and to the left makes it sort of difficult to install it.

During the use of the existing cradle, with the friction between its relatively rotating parts, a higher noise will generally be generated, and the noise will become more evident when the parts are under higher pressure, which will influence the baby's sleep quality.

BRIEF SUMMARY OF THE INVENTION

For the deficiency of the existing technology, the present invention aims at providing a new cradle to facilitate the baby caring persons' operation, reduce the noise of cradle during use, and effectively enhance the infant's sleep quality.

To achieve the purpose above, the following technical solution is adopted by the present invention:

a new cradle, including:

a cradle frame, with a limiting rod extending along the height set on it;

a cradle body, which may move up and down along the height of the cradle frame;

elastic connecting pieces, which are connected between the cradle frame and the cradle body;

a noise reducing component, which includes two parallel mounting plates, two opposite 1st pulleys installed on two mounting plates respectively as well as two opposite 2nd pulleys installed between two mounting plates, wherein the rotating axes of the two 1st pulleys are parallel, the rotating axes of the two 2nd pulleys are parallel, and the rotating axis of the 2nd pulley is perpendicular to that of the 1st pulley; the limiting rod passes through the clearance enclosed by the two 1st and the two 2nd pulleys, with a mounting plate fixed to the body of the cradle.

The elastic connecting pieces include two elastic connecting units, with each one having its upper end fixed to the upper end of the cradle frame and its lower end fixed to the connecting arm extending laterally at the side of the mounting plate fixed to the body of the cradle.

The elastic connecting unit is a spring or an elastic rubber hose.

The cradle frame includes a base frame at its bottom as well as two support frames installed at both ends of the upper part of the base frame at the bottom.

On the inner side of the mounting plate which is fixed to the body of the cradle, a connecting plate extending inward is set, to which the end part of the body of the cradle is fixed.

Rolling wheels are set under the bottom of the cradle frame.

The top frame body, which is a clothes-drying rack, a decorative frame or a sunshade frame, is inserted and connected on the top of the cradle.

The favorable effect of the present invention is that:

the reciprocating up-down movement can effectively facilitate the baby's sleep (especially having better effects for babies more than one full year old); the anti-tilt function can ensure the baby's safety; at the same time, by adopting a noise reducing device and changing sliding friction to rolling friction, the present invention can effectively reduce the noise and resistance generated during the up-down movement of the body of the cradle, so that the baby's sleep will not be influenced due to noise; moreover, the cradle can be used to dry clothes when it is unused, being multi-functional. In addition, it is easy to assemble and disassembled place.

DETAILED DESCRIPTION OF THE INVENTION

Figure 1:
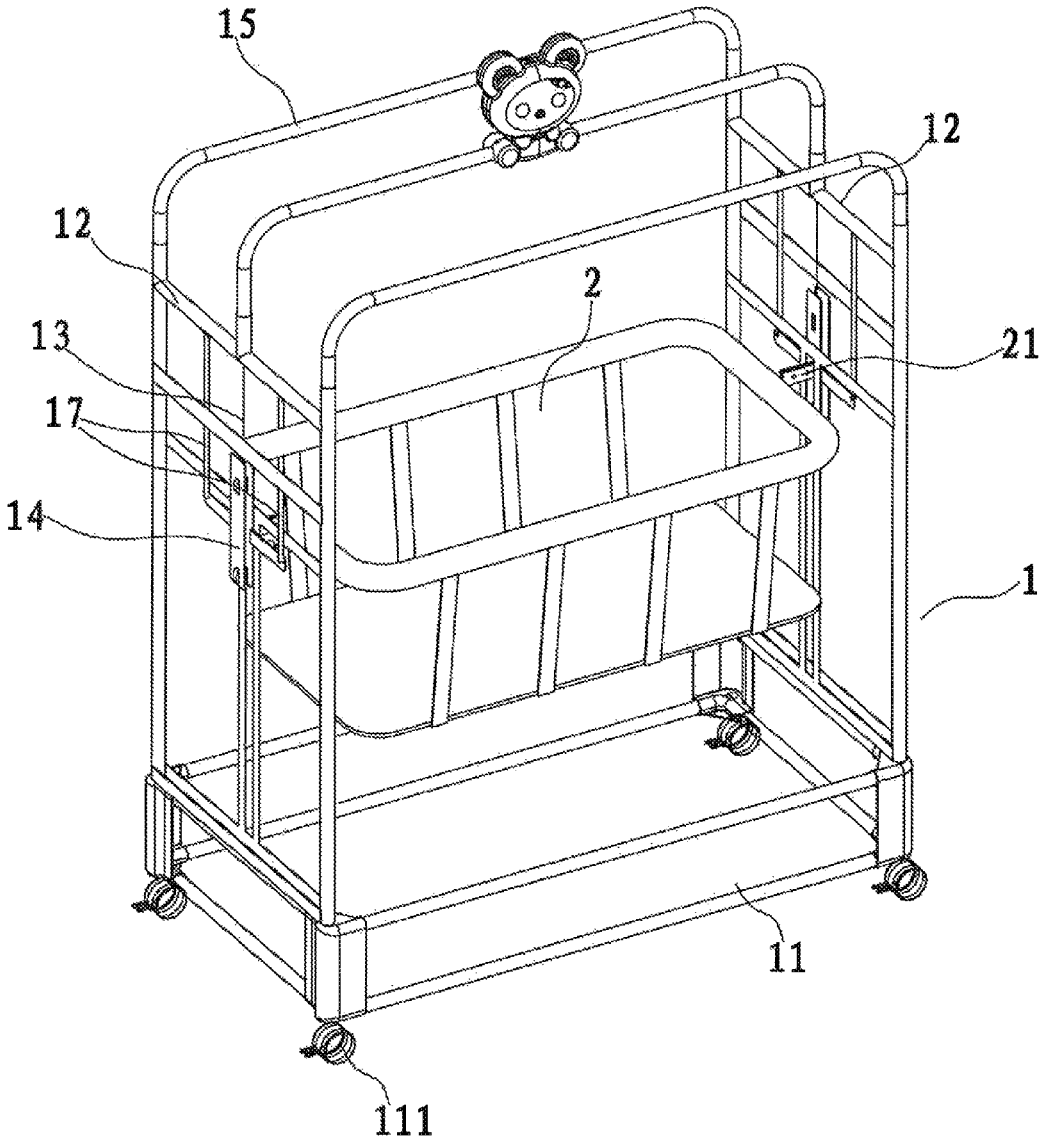
FIG. 1 is the schematic view of the structure of the new cradle in the present invention.

The present invention is further detailed in combination with the drawings and the embodiments hereinafter:

FIG. 1 shows a cradle of the present invention, which includes a cradle frame 1 and a cradle body 2. The cradle frame 1 includes a base frame 11 at the bottom and two support frames 12 at both ends of the base frame 11 at the bottom. The bottom end of support frame 12 is inserted and connected to the base frame 11, and a decorative frame 13 is inserted and connected to the top ends of the two support frames 12. Along the height of cradle frame 1, the cradle body 2 is available for an up-down movement relative to the cradle frame 1.

Figure 2:
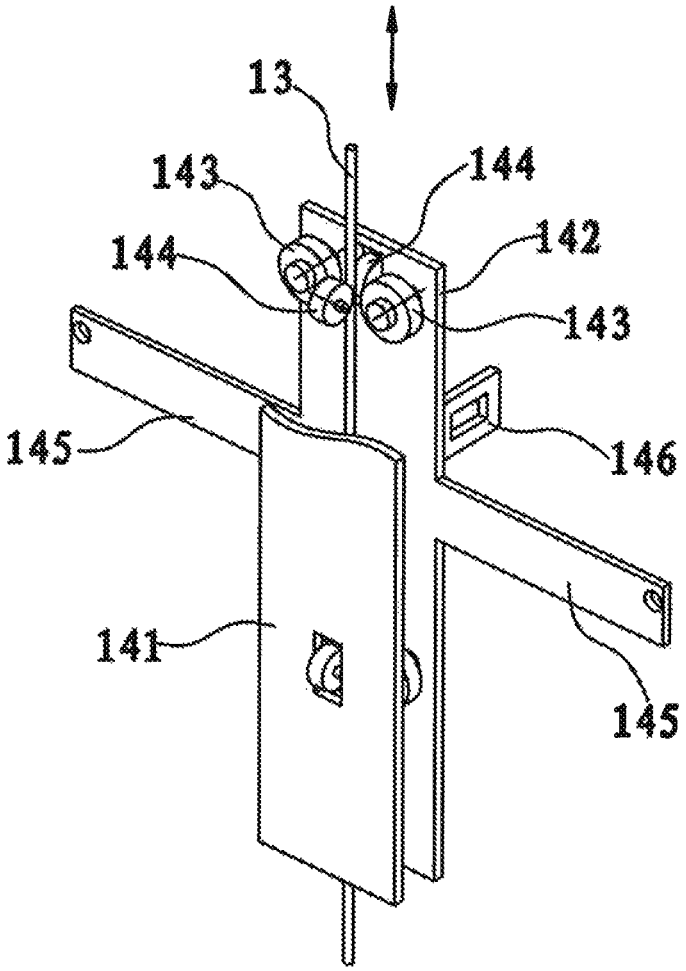
FIG. 2 is the schematic view of the structure of the noise reducing component in FIG. 1.

To prevent against deflection during the up-down movement of cradle body 2, a limiting rod 13 extending along the height is fixed on the support frames 12. A noise reducing component 14 corresponding to the limiting rod 13 is further set. As shown in FIG. 2, the noise reducing component 14 includes two mounting plates 141, 142, which are parallel to each other and extend along the height. On the upper end and lower end of each plate, a pulley block is set. The pulley block includes two pulleys 143 and two pulleys 144. The two pulleys 144 are installed on the two mounting plates 141, 142 respectively, opposite to each other and with their rotating axes parallel to each other. The two pulleys 143 are located between the two mounting plates 141, 142, opposite to each other and with their rotating axes parallel to each other. In addition, the rotating axis of pulley 143 is perpendicular to that of pulley 144, and the two pulleys 143 are located at the two sides of pulleys 144 respectively. Therefore, a limiting clearance is enclosed by the two pulleys 144 and the two pulleys 143, through which the limiting rod 13 passes. On the inner side of the mounting plate 142, a connecting plate 146 extending laterally and fixed to the connecting plate 21 is set for a permanent connection between the noise reducing component 14 and the cradle body 2. When the cradle body 2 is moved up and down relative to the cradle frame 1, the limiting rod 13 will move up and down within the limiting clearance enclosed by the above-mentioned two pulleys 144 and two pulleys 143. With the rolling friction generated between the limiting rod 13 as well as the pulleys 144 and 143, the friction noise and resistance can be reduced effectively, and at the same time it can be ensured that the cradle body 2 will not deflect relative to the cradle frame 1.

Between the cradle frame 1 and the cradle body 2, elastic connecting pieces are also connected, which are able to ensure that the cradle body 2 can perform a reciprocating up-down movement after the external force is released. To be specific, the elastic connecting pieces are two elastic connecting units 17, of which the top ends are both connected to the top end of the support frame 12, while the bottom ends are respectively connected to the connecting arms 145 extending laterally at both sides of the mounting plate 142. The elastic connecting unit 17 may be a spring or an elastic rubber hose.

To facilitate the whole cradle's movement, four rolling wheels 111 are added under the bottom of the base frame 11. The decorative frame 15 may be a clothes-drying rack or a sunshade frame.

The technicians in this field may make various corresponding changes and deformations according to the technical solution and ideas above, but all these should be within the scope of protection claimed by the Claims of the present invention.

What is claimed is:

1. A new cradle, characterized in that, it includes:

a cradle frame, with at least one limiting rod extending along a height of the cradle frame;

a cradle body, which move up and down along the height of the cradle frame;

elastic connecting pieces, which are connected between the cradle frame and the cradle body; and a noise reducing component, which includes two parallel mounting plates, two opposite 1st pulleys installed on the two mounting plates respectively as well as two opposite 2nd pulleys installed between the two mounting plates, wherein the rotating axes of the two 1st pulleys are parallel, the rotating axes of the two 2nd pulleys are parallel, and the rotating axes of the two 2nd pulleys are perpendicular to that of the two 1st pulleys; wherein the limiting rod passes through a clearance enclosed by the two 1st and the two 2nd pulleys, wherein at least one of the mounting plates is fixed to the cradle body.

2. The new cradle as claimed in claim 1, characterized in that the elastic connecting pieces include two elastic connecting units, with each one having an upper end fixed to an upper end of the cradle frame and a lower end fixed to a connecting arm extending laterally at a side of the at least one mounting plate fixed to the cradle body.

3. The new cradle as claimed in claim 2, characterized in that the elastic connecting unit is a spring or an elastic rubber hose.

4. The new cradle as claimed in claim 1, characterized in that the cradle frame includes a base frame at its bottom as well as two support frames installed at two ends of an upper part of the base frame.

5. The new cradle as claimed in claim 1, characterized in that, on an inner side of the at least one mounting plate which is fixed to the cradle body, a connecting plate extending inward is set, to which an end part of the cradle body is fixed.

6. The new cradle as claimed in claim 1, characterized in that rolling wheels are set under the bottom of the cradle frame.

7. The new cradle as claimed in claim 1, characterized in that a top frame body is connected on a top of the cradle frame, wherein the top frame body is selected from the group consisting of a clothes-drying rack, a decorative frame, and a sunshade frame.

* * * * *